United States Patent [19]

Estes et al.

[11] 4,357,231

[45] Nov. 2, 1982

[54] METHOD FOR EXTRACTING HYDROCARBONS FROM OIL SHALE

[75] Inventors: John H. Estes, Wappingers Falls; Ernest P. Buinicky, Newburgh, both of N.Y.

[73] Assignee: Texaco Inc., White Plains, N.Y.

[21] Appl. No.: 267,200

[22] Filed: May 26, 1981

Related U.S. Application Data

[63] Continuation of Ser. No. 153,112, May 23, 1980, abandoned.

[51] Int. Cl.[3] ..... C10G 1/00

[52] U.S. Cl. ..... 208/11 R

[58] Field of Search ..... 208/11 R

[56] References Cited

U.S. PATENT DOCUMENTS

| | | | |
|---|---|---|---|
| 1,373,698 | 4/1921 | Ard | 208/11 R |
| 1,601,777 | 10/1926 | Spotz | 208/11 R |
| 1,734,970 | 11/1929 | Jenson | 208/11 R |
| 2,015,085 | 9/1935 | Oberle | 208/11 R |
| 2,881,126 | 4/1959 | Glinka | 208/11 R |
| 3,977,960 | 8/1976 | Stout | 208/11 R |

*Primary Examiner*—T. Tufariello

*Attorney, Agent, or Firm*—Carl G. Ries; Robert A. Kulason; Robert B. Burns

[57] ABSTRACT

A method and apparatus for thermally treating shale rock which holds an amount of hydrocarbon. The shale, preferably in a reduced size and form, is contacted by a hot molten metal bath at a sufficiently high temperature to release the hydrocarbon segment. The latter rises to the bath surface in liquid form to be skimmed, drained, or otherwise separated from residual rock material which is further conveyed from the lead bath.

5 Claims, 2 Drawing Figures

METHOD FOR EXTRACTING HYDROCARBONS FROM OIL SHALE

This is a continuation, of application Ser. No. 153,112, filed May 23, 1980 now abandoned.

BACKGROUND OF THE INVENTION

The present energy shortfall which faces the world results from a number of conditions. First, and perhaps most pertinent, is the decrease in reserves of fossil type fuel in quantities that permit it to be produced indefinitely. In brief, the world's known oil reserves will prove to be adequate only for an indeterminate limited period of time. One form of relief from this shortage resides in the greater use of oil shale.

Oil shale comprises in essence a relatively impervious rock intermingled with an organic component known as kerogen. The hydrocarbon material can be released most readily through a heating of the shale to a sufficient temperature to thermally decompose the kerogen to an oil and a carbon residue. To most effectively utilize available heat, the shale is preferably crushed or otherwise reduced to a size most convenient to handle and to heat.

The oil segment which is removed from the shale is in many respects equivalent in characteristics to crude oil which is produced from any subterranean reservoir. Thus, the shale oil can be further distilled and otherwise handled to convert it into varying grades of petroleum products such as gasoline, heating oil, etc.

Toward exploiting this potential store of crude petroleum product, there is presently disclosed a novel, yet relatively inexpensive method for releasing and recovering shale oil from shale rock. The method embodies primarily the thermal treating of raw shale at relatively low temperature within a molten metal heating medium. Liquid crude, when thus released will rise to the surface of the heating pool and be readily recovered. Similarly, released gases are withdrawn for use in the process or disposed of leaving only residual shale rock.

It is therefore an object of the invention to provide a simple, yet inexpensive method for extracting oil from shale. A further object is to provide a relatively low temperature method for thermally treating oil shale to release kerogen or the hydrocarbon content thereof. Still another object is to provide a relatively high grade of shale oil which is released in liquid form from the shale, within a molten metal bath wherein the shale is thermally decomposed.

The process in brief as presently disclosed, envisions the thermal treatment of oil shale stocks which are determined to contain a sufficient amount of kerogen to warrant such treatment according to economic criteria. When proper conditions are maintained, virtually 100% of the Fischer assay value of the shale can be realized.

To achieve the best exposure of the raw kerogen containing rock, the latter is initially ground, crushed, or otherwise converted to a convenient size. Since the herein disclosed process relies heavily on the factor of a relatively short heating period, the size of the rock is preferably converted to a grade that will pass through a two inch sieve opening.

During the heating period the shale is immersed into a molten metal bath formed preferably of a lead composition which is at a temperature of approximately 950° F. In such an environment, the kerogen is pyrolyzed.

The liquid product floats onto the bath surface and can be then drained off, or otherwise removed.

The hot gases which are generated by the thermal decomposition of the shale can be recycled for use in preheating the shale prior to its immersion, or they can be otherwise disposed of.

Figure 1:
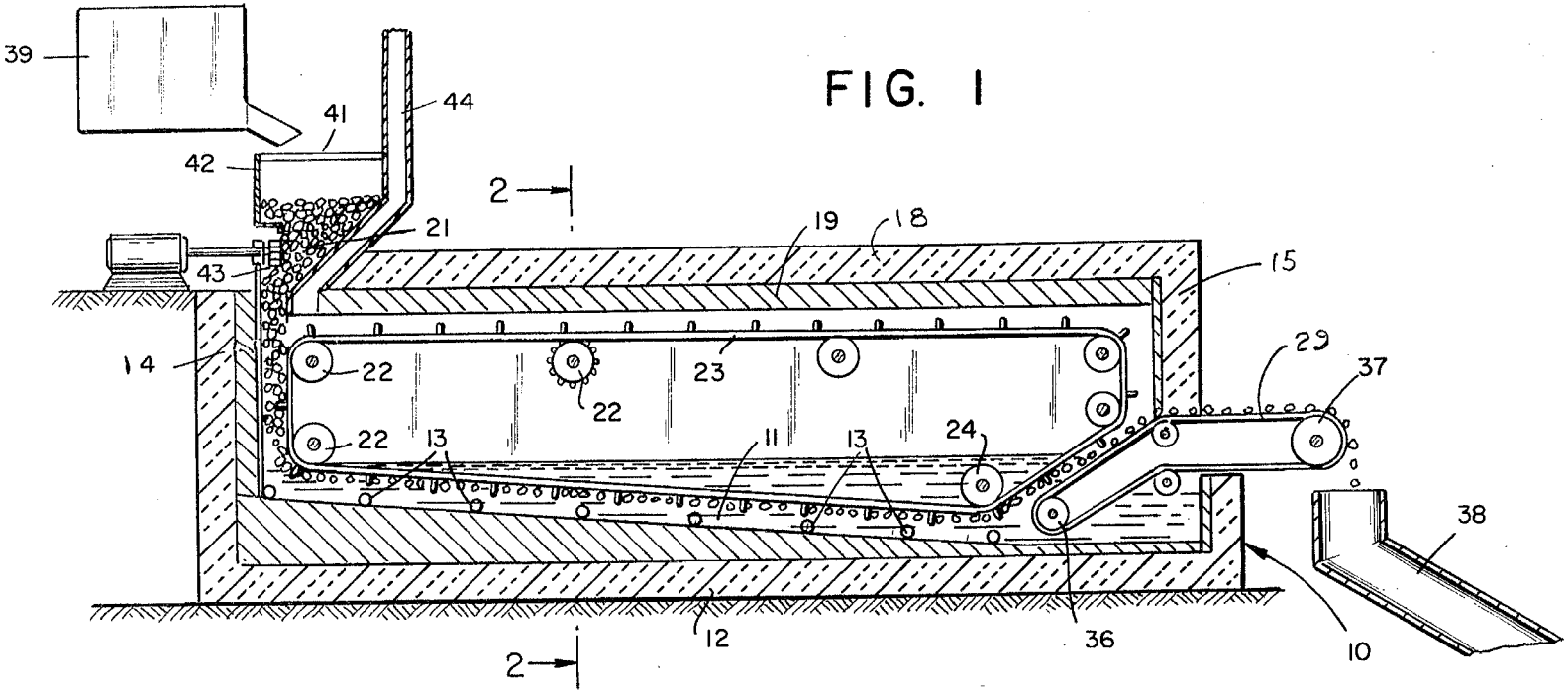
FIG. 1 illustrates an elevation view in cross section of an apparatus of the type contemplated.
Figure 2:
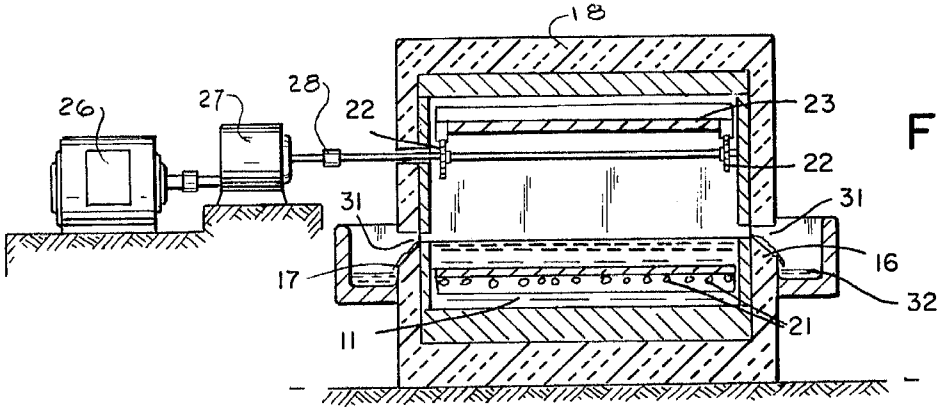
FIG. 2 is a cross sectional view taken along line A—A of FIG. 1.

One embodiment of an apparatus used in carrying out the instant method is shown in FIG. 1. Said apparatus includes primarily an elongated tub-like receptacle 10 adapted to hold a molten metal bath 11. The tub is preferably relatively shallow in depth to minimize the volume of the molten material. Further, it is relatively wide to allow the shale only a minimal dwell period beneath the bath's surface.

Tub 10 is sufficiently strong and reinforced, being formed preferably of welded steel plate to best retain the molten liquid. The floor 12 of the tub is arranged to support a plurality of electric heaters or burners 13. The latter are spaced along the bath to controllably heat and maintain the bath within a desired temperature range. Alternately, the electric heating elements can be retained in the bath 11 side walls 16 and 17, and positioned adjacent to the tub floor.

While not specifically shown, the respective heaters 13 are communicated to a power source together with means for accurately regulating power flow in response to the bath temperature. Said power as noted can be in the form of electric energy, or combustible gas, depending on the character of the heating elements 13 utilized.

The entire bath 11 is positioned within a surrounding enclosure 18 such as the insulated walls 16 and 17, and roof 19. The latter are formed of sheet metal such that the process operating conditions can best be regulated. For maximum effectiveness, the bath unit, as well as the walls and roof can all be lagged or insulated with a suitable material to retain as much heat as possible for use in maintaining the molten bath, as well as for preheating incoming shale 21.

The respective roof 19 and side walls 16 and 17, and end walls 14 and 15 of enclosure 18 are provided with a series of support rollers 22 that extend the width of the bath and are journalled to rotatably support a continuous carrier belt 23. Since at least a section of belt 23 is submerged beneath the molten bath surface, at least one roller 24 and preferably two, are likewise positioned beneath said surface.

Belt 23 is driven by a motor 26 or similar power unit which operates through a transmission 27 communicated to at least one drive shaft 28. Thus, the forward speed of belt 23 can be regulated to achieve an optimum time for shale immersion, to give maximum efficiency in terms of yield and throughput.

Belt 23 extends for substantially the length of the tub 10 and enclosure 18 such that shale received at the one end will be immersed beneath the hot bath, and will be carried to the tub discharge end. Due to the differential in density between the melted lead 11 and the shale 21, the latter will tend to float to the bath's surface. Belt 23 thus is arranged and guided with its lateral edges disposed contiguous with the bath side walls 16 and 17. Further, at said tub discharge end the belt is guided to leave the bath at an upward angle. Thus, oil-free residual shale rocks are carried from bath 11 and deposited onto a second or discharge belt 29.

At least one, and preferably both edges of the bath-retaining tub 10 are defined by an overflow channel such as 31. The latter is disposed at the tub 10 upper rim to confine the molten bath 11, and yet permit oil floating on the surface of bath 11 to overflow the channel lip. The respective overflow channels 31 include in essence a flow trough 32 so positioned to lead the hot overflowing shale oil stream to a heated receptacle or other means for handling the hot released oil.

Structurally, belts 23 and 29 are flexible or articulated, and preferably hinged of metal plates such as steel or iron which will operate efficiently at the temperature of, and while submerged within molten bath 11. The hinged plates of belt 23 are perforated with a sufficient number of through openings that released oil can immediately rise upwardly through the plates and to the bath surface. The shale on the other hand is retained at the belt underside while being buoyed upward by the molten lead.

To assure progress of the submerged shale pieces along the length of bath 11, belt 23 is provided with a series of upstanding barrier members 34 which depend from the belt outer surface. The shale pieces are thus sufficiently confined to assure their being held in place, and not floating to the lead bath surface.

The second belt 29 is mounted at the tub discharge end to receive the spent shale rocks or pieces as the latter emerge from bath 11. Second belt 29 thus is guidably mounted to a series of transverse support rollers 36 and 37. The latter are positioned to permit the belt to carry the spent shale away from the bath as the pieces rise to the bath surface. The shale is then discharged into an appropriate receiving vessel 38.

At least one of the second belt 29 supporting rollers such as 37, is operably connected through a chain or otherwise to the drive shaft 28 of belt 23. Alternately, separate drive means can be provided such that the speed of belt 29 can be readily coordinated with the speed of the shale submerging belt 23.

The shale aggregate will normally be in an initial condition embodying varying sizes and weights. For optimum results in the present method, the shale is segmented or treated by crushing, grading, screening and the like to achieve a degree of uniformity in size within the range of about ¼ to 3 inches. This uniformity will assure the maximum production of shale oil for the heat energy input expended.

Further, regulation of the shale size to a preferred minimum range, will increase the rate of productivity. Thus at a set bath temperature, the submersion time period can be controlled to yield oil in the desired liquid state rather than as a vapor.

Operationally, untreated shale at a proper unit size is fed onto the outer surface of belt 23 at a point adjacent to wall 14, and prior to introduction to the bath 11. Thus, the crude shale after having passed through a crusher 39 or the like, is further deposited onto a screen 41 having openings of approximately two inches. The shale rock is now fed into the feed hopper 42. The latter is provided with a screw-type feed mechanism 43 which terminates at the hopper's lower discharge end. The latter in turn is disposed adjacent to the loading end of belt 23 adjacent to wall 14.

The roof 19 of enclosure 18 can be provided with one or more exhaust ducts 44 to carry off gases which pass upwardly from the molten bath 11. Gases such as H S and the like not only contain reusable heat, but they can be collected and used for other purposes. The hot gases for example can be received into the exhaust system and carried along duct 44 to be brought into heat exchange contact with shale in hopper 42. The latter is thus preheated to a desired degree before entering the molten bath 11.

Incoming shale could also be preheated using exhaust gases. The latter, for example, can be received in a knock back apparatus and passed in condensed form into contact with the shale.

Bath 11 as herein mentioned, is comprised of a molten metal such as lead, or a lead composition which is heated to bring the bath to a molten state and desired temperature. The lead will be characterized by a density between about 11.00 to 11.50 grams per cubic centimeter. Preferably, the operation is carried out at a relatively low temperature within the range of 950° to 1000° F. At this temperature, the shale, when introduced to the hot bath, will decompose and release the retained oil in a relatively short period of time.

In the production of synthetic crude or shale oil by the disclosed lead retorting process, a number of economic advantages are realized. Of primary consideration is the relatively low bath temperature, that is 950° to 1000° F., is not only sufficient to release kerogen, but it avoids an undue amount of vaporization. Of further consideration, decomposition of carbonates from the shale is greatly minimized. In one example, immersion of shale rock having a size of about 2 inches, into a lead bath having a temperature of about 1000° F., gave a satisfactory oil yield. The immersion time was approximately two minutes in the lead bath.

The retention of crude oil in liquid state reflects a saving in actual processing costs due to the limited heat requirements and to the readily controlled heating medium. Since the released oil passes upwardly through the bath out of contact with the residual shale, the latter will not have the effect of catalyzing further reaction of the oil. Further, the minimal shale heating period lessens the opportunity for further cracking of the crude product, a factor that would tend to otherwise reduce the overall product output.

The synthetic crude obtained by the instant process embodies the still further advantage of being characterized by an approximate 80% of olefins, and is consequently much more amenable to subsequent hydrotreating. This contrasts with the generally used higher temperature of produced shale oils which are often characterized by the formation of very stable ring compounds containing the hetero atoms S and N, that is, thiophene and pyridine derivatives.

Other modifications and variations of the invention as hereinbefore set forth can be made without departing from the spirit and scope thereof, and therefore, only such limitations should be imposed as are indicated in the appended claims.

We claim:

1. Method for extracting the hydrocarbon segment from shale rock which contains an amount of such hydrocarbon, which method includes the steps of.

providing a molten bath having a temperature within the range of about 900° to 1000° F. and comprised of a lead based metal, contacting said shale rock having a size between about ¼ and 3 inches, with said molten bath for sufficient period of time to thermally release the hydrocarbon segment therefrom whereby the said hydrocarbon segment will rise to the bath surface separating the floating liquified hydrocarbon from the surface of the molten bath prior to said liquid becoming vaporized, and passing hot gas which is radiated from said molten bath, into heat exchange relation with said shale rock prior to contact of the latter with the molten bath.

2. In the method as defined in claim 1, wherein the density of the molten bath exceeds the density of the hydrocarbon portion.

3. In the method as defined in claim 1, wherein said molten bath is comprised primarily of a metal composition having a melting point between approximately 600° and 625° F.

4. In the method as defined in claim 1, including the step of; maintaining said molten bath at a temperature within the range of 950° F. and 1000° F.

5. In the method as defined in claim 1, wherein hydrocarbon liquid is separated from said molten metal bath by skimming the surface of the latter.

* * * * *